US005472629A

United States Patent [19]

Lysy et al.

[11] Patent Number: 5,472,629

[45] Date of Patent: Dec. 5, 1995

[54] THICKENED ACID MICROEMULSION COMPOSITION

[75] Inventors: Regis Lysy, Olne; Marchal Maurice, Oster-Manhay; Claude Blanvalet, Angleur, all of Belgium

[73] Assignee: Colgate-Palmolive Co., Piscataway, N.J.

[21] Appl. No.: 338,357

[22] Filed: Nov. 14, 1994

Related U.S. Application Data

[63] Continuation-in-part of Ser. No. 105,500, Aug. 17, 1993, abandoned, which is a continuation-in-part of Ser. No. 950,370, Sep. 24, 1992, abandoned.

[51] Int. Cl.[6] ..... C11D 7/08; C11D 1/38; C11D 1/66; C23G 1/02

[52] U.S. Cl. ..... 252/142; 252/545; 252/554; 252/174.19; 252/174.17; 252/174.16; 252/174.21

[58] Field of Search ..... 252/142, 545, 252/554, 174.19, 174.17, 174.16, 174.21

[56] References Cited

U.S. PATENT DOCUMENTS

| | | | |
|---|---|---|---|
| 4,581,161 | 4/1986 | Nedonchelle | 252/550 |
| 4,759,867 | 7/1988 | Choy et al. | 252/143 |
| 4,944,892 | 7/1990 | Leathers et al. | 252/92 |

FOREIGN PATENT DOCUMENTS 336878 10/1989 European Pat. Off. .

*Primary Examiner*—Paul Lieberman
*Assistant Examiner*—M. Kopec
*Attorney, Agent, or Firm*—Richard E. Nanfeldt; Robert C. Sullivan; Murray Grill

[57] ABSTRACT

An acidic thickened microemulsion composition which is sprayable as well as being shear thinning and readily clings to vertical walls is effective in removing soap scum. The acidic microemulsion composition comprises specific amounts of anionic surfactant, nonionic surfactant, an acid mixture of succinic acid, glutaric acid and adipic acid, and a xanthan gum thickener having a molecular weight of about 1,000,000 to 10,000,000.

5 Claims, No Drawings

THICKENED ACID MICROEMULSION COMPOSITION

RELATED APPLICATIONS

This application is a continuation in part application of U.S. Ser. No. 8/105,500 filed Aug. 17, 1993, now abandoned which in turn is a continuation in part application of U.S. Ser. No. 07/950,370 filed Sep. 24, 1992, now abandoned.

FIELD OF INVENTION

This invention relates to a thickened cleaner for hard surfaces, such as bathtubs, sinks, tiles, porcelain and enamelware, which removes soap scum, lime scale and grease from such surfaces without harming them. The composition is sprayable from a bottle and will clinge to a vertical surface. The composition is also shear thinning which means that it can be easily removed from the wall without excessive mechanical action. More particularly, the invention relates to an acidic microemulsion that is thickened and that can be sprayed onto the surface to be cleaned, and wiped off without usual rinsing and still leave the cleaned surface bright and shiny. The invention also relates to a method for using such compositions.

BACKGROUND OF INVENTION

Hard surface cleaners, such as bathroom cleaners and scouring cleansers, have been known for many years. Scouring cleansers normally include a soap or synthetic organic detergent or surface active agent and an abrasive. Such products can scratch relatively soft surfaces and can eventually cause them to appear dull. These products are often ineffective to remove lime scale (usually encrusted calcium and magnesium carbonates) in normal use. Because lime scale can be removed by chemical reactions with acidic media various acidic cleaners have been produced and have met with various degrees of success. In some instances such cleaners have been failures because the acid employed was too strong and damaged the surfaces being cleaned. At other times, the acidic component of the cleaner reacted objectionably with other components of the product which adversely affected the detergent or perfume. Some cleaners required rinsing afterward to avoid leaving objectionable deposits on the cleaned surfaces. As a result of research performed in efforts to overcome the mentioned disadvantages there has recently been made an improved liquid cleaning composition in stable microemulsion form which is an effective cleaner to remove soap scum, lime scale and greasy soils from hard surfaces, such as bathroom surfaces and which does not require rinsing after use. Such a product is described in U.S. Pat. No. 5,076,954 which patent is hereby incorporated by reference. In particular, Example 3 of that application discloses an acidic, clear, oil-in-water microemulsion which is therein described as being successfully employed to clean shower wall tiles of lime scale and soap scum that had adhered to them. Such cleaning was effected by applying the cleaner to the walls followed by wiping or minimal rinsing after which the walls were allowed to dry to a god shine.

The described thickened microemulsion cleaner of U.S. Pat. No. 5,076,954 is effective in removing lime scale and soap scum from hard surfaces and is easy to use, but it has been found that its mixture of acidic agents (succinic, glutaric and adipic acids) could damage the surfaces of some hard fixtures, such as those of materials which are not acid resistant. One of such materials is an enamel that has been extensively employed in Europe as a coating for bathtubs, herein referred to as European enamel. It has been described as zirconium white enamel or zirconium white powder enamel and has the advantage of being resistant to detergents, which makes it suitable for use on tubs, sinks, shower tiles and bathroom enamelware. However, such enamel is sensitive to acids and is severely damaged by use of the microemulsion acidic cleaner based on the three organic carboxylic acids previously mentioned. This problem was been solved by EPO Patent Application No. 0336878A2, wherein additional acidic materials were incorporated in the cleaner with the organic acids and rather than exacerbating the problem, they prevent harm to such European enamel surfaces by such organic acids. Also, a mixture of such additional acids, phosphonic and phosphoric acids surprisingly further improves the safety of the aqueous cleaner for use on such European enamel surfaces and decreases the cost of the cleaner.

The instant compositions of the present invention allow the cleaning of European enamel surfaces, as well as any other acid resistant surfaces of bathtubs and other bathroom surfaces. The product can be used on various other materials that are especially susceptible to attack by acidic media, such as marble. Additionally, the instant compositions are stable at 25° C for at least 3 months and are shear thinning.

SUMMARY OF THE INVENTION

In accordance with the present invention, a thickened acidic aqueous cleaner for bathtubs and other hard surfaced items, which are acid resistant or are of zirconium white enamel, wherein the cleaner has a pH in the range of 1 to 4 and the cleaner removes lime scale, soap scum and greasy soil from surfaces of such items without damaging such surfaces, comprises a xanthan gum thickener; a detersive proportion of at least one synthetic organic detergent which is capable of removing greasy soil from such surfaces; a lime scale and soap scum removing proportion of dicarboxylic acid(s) having 2 to 10 carbon atoms, an aminoalkylenephosphonic acid in such proportion as to prevent damage to zirconium white enamel surfaces of items to be cleaned by the dicarboxylic acid(s), and an aqueous medium for the detergent, phosphoric acid, dicarboxylic acid(s) and aminoalkylenephosphonic acid.

DETAILED DESCRIPTION OF THE INVENTION

The instant invention relates to a thickened, shear thinning acidic microemulsion compositions which comprises approximately by weight:

(a) 1 to 6 percent of an anionic surfactant such as a $C_{14-17}$ paraffin sodium sulfonate;

(b) 1 to 6 percent of a nonionic surfactant such as a $C_{13-15}$ Fatty Alcohol EO 7:1/PO4:1

(c) 0 to 0.7 percent of a preservative such as an alkali metal benzoate such as sodium benzoate;

(d) 0.1 to 0.7 percent of a xanthan gum thickener having a molecular weight of about 1,000,000 to 10,000,000 such as Kelzan T sold by Merck & Co.;

(e) 0 to 0.3 percent of an alkali metal hydroxide;

(f) 0 to 1.0 percent, more preferably 0.05 to 1.0 percent of phosphoric acid;

(g) 0 to 0.5 percent of an amino trismethylene phosphonic acid;

(h) 0 to 0.1 percent of a dye;

(i) 0 to 2.0 percent of a perfume;

(j) 2 to 8 percent of an acid mixture of succinic acid; glutaric acid and adipic of about 1:1:1; and (k) balance being water, wherein the composition has a pH of about 1 to about 4, more preferably about 2.7 to about 3.3 and a Brookfield viscosity of about 200 to 1,000 cps at 25° C. using a #2 spindle and 50 rpms.

In the present compositions, the synthetic organic detergent may be any suitable anionic, nonionic, amphoteric, ampholytic, zwitterionic or cationic detergent or mixture thereof, but the anionic and nonionic detergents are preferred, as are mixtures thereof. Of the anionics the more preferred are water soluble salts of lipophilic sulfonic and sulfuric acids, the lipophilic moieties of which include long chain aliphatic groups, preferably long chain alkalis of 8 to 20 carbon atoms, more preferably of 12 to 18 carbon atoms Although several different types of solubilizing cations may be present in the detergents it will usually be preferred that they be alkali metal, e.g. sodium or potassium or a mixture thereof, ammonium, or lower alkanolamine of 2 or 3 carbon atoms per alkanol mole. It is a desirable feature of the present invention that sodium may be the alkali metal employed and the emulsions resulting will be stable and effective.

Much preferred salts of lipophilic sulfonic acids are paraffin sulfonates, wherein the paraffin group is of 12 to 18 carbon atoms, preferably 14 to 17 carbon atoms. Other useful sulfonates are olefin sulfonates are olefin sulfonates wherein the olefin starting material is of 12 to 18 carbon atoms, e.g., 12 to 15, and linear alkylbenzene sulfonates, wherein the alkyl group is of 12 to 18 carbon atoms, preferably of 12 to 16 carbon atoms, e.g. 12 or 13. All such sulfonates will preferably be employed as their sodium salts, but other salts are also operative.

Much preferred salts of lipophilic sulfuric acids are of higher alkyl ethoxylate sulfuric acids, which may also be designated as higher alkyl ethyl ether sulfuric acids. The higher alkyls of such compounds are of the chain lengths given above for this class of anionic detergents, 10 to 18 carbon atoms, and preferably are of 10 to 14 carbon atoms, e.g., 12 or about 14 carbon atoms. Such compounds should include from 1 to 10 ethylene oxide groups per mole, preferably 3 to 7 ethylene oxide groups per mole, e.g.5. A preferred cation is sodium but the cations mentioned above for solubilizing functions may be employed in suitable circumstances.

The nonionic detergents that are useful in this invention may be any of the nonionic detergents known to the art (as may be the anionic detergents that satisfy the conditions set in this specification). Many such detergents are described in: *Surface Active Agents(Their Chemistry and Technology)* by Schwartz and Perry, and in the various annual editions of John W. McCutcheon's *Detergents and Emulsifiers*. However, they will usually be condensation products of a lipophilic moiety, such as a higher alcohol or phenol, or a propylene glycol or propylene oxide polymer, with ethylene oxide or ethylene glycol. In some of the condensation products of ethylene oxide and higher fatty alcohol or alkyl substituted phenol (In which the alkyl on the phenol nucleolus is usually of 7 to 12 carbon atoms preferably 9), some propylene oxide may be blended with the ethylene oxide so that the lower alkylene oxide molely in the nonionic detergent is mixed, whereby the hydrophilic-lipophilic balance (HLB) may be controlled.

Much preferred nonionic detergents present in the invented emulsions will be condensation products of a fatty alcohol of 8 to 20 carbon atoms with from 1 to 20 moles of ethylene oxide, preferably of a linear alcohol of 9 to 15 carbon atoms, such as 9–11 or 11–13 carbon atoms or averaging about 10 or 12 carbons, with 3 to 15 moles of ethylene oxide, such as 3–7 or 5–9 moles of ethylene oxide, e.g., about 5 or 7 moles thereof. In place of the higher fatty alcohol one may use an alkylphenol, such as one of 8 to 10 carbon atoms in a linear alkyl, e.g., nonylphenol, and the phenol may be condensed with from 3 to 20 ethylene oxide groups, preferably 8 to 15. Similarly functioning nonionic detergents that are polymers of mixed ethylene oxide and propylene oxide may be substituted, at least in part for the other nonionics. Among such are those sold under the trademark Plurafac such as Plurafac RA-30 and Plurafac LF-400 available from BASF. Preferred such nonionics contain 3 to 10 ethoxies, more preferably about 7, and 2 to 7 propoxy groups, more preferably about 4, and such are condensed with a higher fatty alcohol of 12–16, more preferably 13–15 carbon atoms to make a mole of nonionic detergent.

The active acidic component of the thickened acidic microemulsions is a carboxylic acid which is strong enough to lower the pH of the microemulsion to one in the range of one to four. Various such carboxylic acids can perform this function but those which have been found effectively to remove soap scum and lime scale from bathroom surfaces best, while still not destabilizing the emulsion, are polycarboxylic acids, and of these the dicarboxylic acids are preferred. Of the dicarboxylic acids group, which includes those of 2 to 10 carbon atoms, from oxalic acid through sebacic acid suberic, azelaic and sebacic acids are of lower solubilities and therefore are not as useful in the present emulsions as the other dibasic aliphatic fatty acids, all of which are preferably saturated and straight chained.. Oxalic and malonic acids, although useful as reducing agents too, may be too strong for delicate hard surface cleaning. Preferred such dibasic acids are those of the middle portion of the 2 to 10 carbon atom acid range, succinic, glutaric, adipic and pimelic acids, especially the first three thereof, which fortunately are available commercially, in mixture. Citric acid can also be employed as the acid.

The carboxylic acid, after being incorporated in the thickened acidic emulsion, may be partially neutralized to produce the desired pH in the emulsion, for greatest functional effectiveness, with safety.

Phosphoric acid is one of the additional acids that helps to protect acidsensitive surfaces being cleaned with the present emulsion cleaner. Being a tribasic acid, it too may be partially neutralized to obtain an emulsion pH in the desired range. For example. It may be partially neutralized to the biphosphate, e.g., $N_aH_2PO_4$, or $NH_4H_2PO_4$.

Phosphonic acid, the other of the two additional acids for protecting acidsensitive surfaces from the dissolving action of the dicarboxylic acids of the present thickened emulsions, apparently exists only theoretically, but its derivatives are stable and are useful in the practice of the present invention. Such are considered to be phosphonic acids as that term is used in this specification. The phosphonic acids are of the structure.

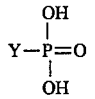

wherein Y is any suitable substituent, but preferably Y is alkylamino or N-substituted alkylamino. For example, a preferred phosphonic acid component of the present thickened acidic emulsions is aminotris (methylenephosphonic) acid which is of the formula N ($CH_2PH_xO_3$) Among other useful phosphonic acids are ethylene diamine tetra-(methylenephosphonic) acid, hexamethylenediamine tetra-(methylenephosphonic) acid, ad diethylenetriamine penta-(methylenephosphonic) acid. Such class of compounds may be described as aminoalkylenephosphonic acids containing in the ranges of 1 to 3 amino nitrogen, 3 or 4 lower alkylenephosphonic acid groups in which the lower alkylene is of 1 or 2 carbon atoms, and 0 to 2 alkylene groups of 2 to 6 carbon atoms each, which alkylene(s) is/are present and join amino nitrogen when a plurality of such amino nitrogen is present in the aminoalkylenephosphonic acid. It has been found that such aminoalkylenephosphonic acids, which also may be partially neutralized at the desired pH of the microemulsion cleaner, are of desired stabilizing and protecting effect in the invented cleaner, especially when present with phosphate acid, preventing harmful attacks on European enamel surfaces by the diacid(s) components of the cleaner. Usually the phosphorus acid salts, if present, will be monosalts of each of the phosphoric and/or phosphonic acid groups present.

The thickener which is used in the thickened acidic microemulsion is a xanthan gum called Kelzan T and sold by Merck & Co. The xanthan gum is an exocellular hetropolysaccharide having a molecular weight of about 1,000,000 to 10,000,000 and is used in a concentration of about 0.1 to about 0.7 weight percent, more preferably 0.2 to 0.6 weight percent. When the xanthan gum is used at these concentration levels, the composition retains its microemulsion characteristics in that the essential micellar aggregates are maintained, wherein the composition is sprayable and will nicely cling to a vertical wall. Additionally, the compositions having the xanthan gum incorporates therein are shear thinning which means that the composition can be easily removed from the surface being cleaned without much mechanical action. If other thickeners such as cellulose, hydroxypropyl cellulose, polyacrylamides and poly vinyl alcohol are used in the composition in place of the xanthan gum, the resulting composition will be either shear thickening or the viscosity will not change upon the application of force but these compositions will not be shear thinning as are the compositions made with xanthan gum. Additionally, a major requirement of the instant composition is that the composition is stable at 25° C. for at least 30 days. A composition is stable, when it remains as a homogenous one phase composition and there is no phase separation or precipitation.

The water that is used in making the present microemulsions may be tap water but is preferably of low hardness, normally being less than 150 parts per million (p.p.m.) of hardness. Still, useful cleaners can be made from tap waters that are higher in hardness, up to 3000 p.pm. Most preferably the water employed will be distilled or deionized water, in which the content of hardness ions is less than 25 p.p.m.

Various other components may desirably be present in the invented cleaners, including preservatives such as sodium benzoate, antioxidants or corrosion inhibitors, cosolvents, cosurfactant, multivalent metal ions, perfumes, colorants and terpenes (and terpineois), but various other adjuvants conventionally employed in liquid detergents and hard surface cleaners may also be present, provided that they do not interfere with the cleaning and scum-and scale-removal functions of the cleaner. Of the various adjuvants (which are so identified because they are not necessary for the production of an operative cleaner, although they may be very desirable components of the cleaner) the most important are considered to be the perfumes, which, with terpenes, terpineols and hydrocarbons (which may be substituted for the perfumes or added to them) function as especially effective solvents for greasy soils on hard surfaces being leaned, and form the dispersed phases of oil-in-water (o/w) microemulsions. Also of functional importance are the co-surfactant and polyvalent metal ions, with the former helping to stabilize the microemulsion and the latter adding in improving detergency, especially for more dilute cleaners, and when the polyvalent salts of the anionic detergent employed are more effective detergents against the greasy soil encountered in use.

The various perfumes that have been found to be useful in forming the dispersed phase of the thickened acidic microemulsion cleaners may be those normally employed in cleaning products and preferably are normally in liquid state. They include esters, ethers, aldehydes, alcohols and alkanes employed in perfumery but of most importance are the essential oils that are high in terpene content. It appears that the terpenes (and terpineols) coact with the detersive components of microemulsions to improve detergency of the invented compositions, in addition to forming the stable dispersed phase of the microemulsions. In the present invention it has been found that especially when a piney perfume is being employed, one can decrease the proportion of comparatively expensive such perfume and can compensate for it with alpha-terpineol, and in some instances with other terpenes. For example, for every 1% of perfume one can substitute from 60 to 90% of it, w.g., about 80%, with alpha-terpineol, and obtain essentially the same piney scent, with good cleaning and microemulsion stability. Similarly, terpenes and other terpene-like compounds and derivatives may be employed, but alpha-terpineol is considered to be the best.

The polyvalent metal ion present in the invented cleaners may be any suitable ion including, but not limited to, magnesium (usually preferred) aluminum, copper, nickel, iron or calcium. The ion or mixture thereof may be added in any suitable form, sometimes as an oxide or hydroxide, but usually as a water soluble salt. It appears that the polyvalent metal ion reacts with the anion of the anionic detergent (or replaces the detergent cation, or makes an equivalent solution in the emulsion), which improves detergency and generally improves other properties of the product, too. If the polyvalent metal ion reacts with the detergent anion to form an insoluble product such polyvalent ion should be avoided. For example, calcium reacts with paraffin sulfonate anion to form an insoluble salt, so calcium ions, such as might be obtained from calcium chloride, will be omitted from any microemulsion cleaners of this invention that contain paraffin sulfonate detergent. Similarly, those polyvalent ions or other components of the invented compositions that will react adversely with other components will also be omitted. As was mentioned previously, the polyvalent metal ion will preferably be magnesium, and such will be added to the other emulsion components as a water soluble salt. A preferred such salt is magnesium sulfate, usually employed as its heptahydrate (Epson salts), but other hydrates there or the anhydride may be used too. Generally, the sulfates of the polyvalent metals with the used because the sulfate anion thereof is also the anion of some of the anionic detergents and is found in some such detergents as a byproduct of neutralization.

The cosurfactant component(s) of the thickened acidic microemulsion cleaners reduce the interfacial tension or surface tension between the lipophilic droplets and the continuous aqueous medium to a value that is often close to $10^{-3}$ dynes/cm., which results in spontaneous disintegrations of the dispersed phase globules until they become so small as to be invisible to the human eye forming a clear microemulsion. In such a microemulsion the surface area of the dispersed phase increases greatly and its solvent power and grease removing capability are also increased, so that the thickened acidic microemulsion is significantly more effective as a cleaner for removing greasy soiled than when the dispersed phase globules are of ordinary emulsion size. Among the cosurfactants that are useful in the invented cleaners are: water soluble lower alkanols of 2 to 4 carbon atoms per molecule (sometimes preferably 3 or 4): polypropylene glycols of 2 to 18 propoxy units; monoalkyl lower glycol ethers of the formula $RO(X)_nH$, wherein R is $C_{1-4}$ alkyl, X is $CH_2CH_2CH_2O$ or $CH(CH_3)CH_2O$, and n is from 1 to 4; monoalkyl esters of the formula $R^1$ if $C_{2-4}$ acyl and X and n are as immediately previously described; aryl substituted alkanols of 1 to 4 carbon atoms; propylene carbonate; aliphatic mono- di and tricarboxylic acids of 3 to 6 carbon atoms; mono- di- and tri hydroxy substituted aliphatic mono- di- and tricarboxylic acids of 3 to 6 carbon atoms; higher alkyl ether poly-lower alkoxy carboxylic acids; lower alkyl mono- di- and triesters of phosphoric acid wherein the lower alkyl is of 1 to 4 carbon atoms; and mixtures thereof.

Representative of such cosurfactants are succinic, glutaric and adipic acids, diethylene glycol monobutyl ether, dipropylene glycol monobutyl ether and diethylene glycol monoisobutyl ether, which are considered to be the most effective.

From the foregoing discussion of useful cosurfactants in the present cleaners it is apparent that succinic, glutamic and adipic acids, and a mixture of such components are useful for lowering the pH of the product so that it removes soap scum and lime scale easily from surfaces to be cleaned, and at the same time they function as cosurfactants, improving the appearance of the product and making it more effective for removing grease from such surfaces. Similar dual effects may be obtained by use of other of the named acidic materials that have cosurfactant activities in the described cleaners.

In the invented cleaners it is important that the proportions of the components are in certain ranges so that the product may be most effective in removing greasy soils, lime scale and soap scum, and other deposits from the hard surfaces subjected to treatment, and so as to protect such surfaces during such treatment. As was previously referred to the detergent should be present in detersive proportion, sufficient to remove greasy and oily soils; the proportion(s) of carboxylic acid(s) should be sufficient to remove soap scum and lime scale; the phosphonic acid or phosphoric and phosphonic acids mixture should be enough to prevent damage of acid sensitive surfaces by the carboxylic acid(s); and the aqueous medium should be a solvent and suspending medium for the required components and for any adjuvants that may be present, too. Normally, such percentages of components will be by weight: 0.1 to 0.7 xanthan gum, 2 to 8% of synthetic anionic organic detergent(s), 1 to 6% of synthetic organic nonionic detergent(s), 2 to 6% of synthetic organic nonionic detergent(s), 2 to 6% of aliphatic carboxylic acids (preferably diacids), 0.05 to 1.0% of phosphoric acid or mono-salt thereof and 0.005 to 0.5% of phosphonic acid(s), aminoalkylenephosphonic acid(s), or mono-phosphonic salt(s) thereof: and the balance water and adjuvant(s) if any are present. Of the carboxylic acids, it is preferred that atric acid or a mixture of succinic, glutaric and adiplo acids be employed, and the ratio thereof will most preferably be in the range of 1–3:1-6:1–2, within 1:1:1 and about 2:5:1 ratios being most preferred. The ratios of phosphonic acid (preferably aminoalkylenephosphonic acid) to phosphoric acid to aliphatic carboxylic diacids (or carboxylic acids) are usually about 1:1–20: 20–500, preferably being 1:2–10; 10–200 and more preferably being about 1:4:25,1:7:170 and 1:3:25, in three representative formulas. However, one may have ranges as wide as 1: 1–2,000: 10–4,000 and sometimes the preferred range of phosphonic acid to dicarboxylic acid is 5:1 to 250:1. Similarly, a mixture of succinic, glutaric and adipic acids may be of ratio of 0.8–4: 0.8–10:1.

Usually there will be present in the cleaner, especially when paraffin sulfonate is the detergent 0.05 to 5%, and preferably 0.1 to 0.3% of polyvalent ion, preferably magnesium or aluminum, and more preferably magnesium. Also, the percentage of perfume will normally be in the 0.2 to 2% range, preferably being in the 0.5 to 1.5% range of which perfume at least 0.1% is terpene or terpineol. The terpineol is alpha-terpineol and is preferably added to allow a reduction in the amount of perfume, with the total perfume (including the alpha-terpineol) being 50 to 90% of terpineol, preferably about 80% thereof.

For preferred formulas of the present cleaners, which are different in that one contains two anionic detergents and the other only one, the latter will contain 3 to 5% of sodium paraffin sulfonate, wherein the paraffin is $C_{14-17}$, 2 to 4% of nonionic detergent which is a condensation product of a fatty alcohol, 3 to 7% of a 1:1:1 or 2:5:1 mixture of succinic, glutaric and adipic acids, 0.1 to 0.3% of phosphoric acid, 0.03 to 0.1% of aminotris-(methylenephosphonic acid), 0. 1 to 2% of magnesium ion, 0.5 to 2% of perfume, of which 50 to 90% thereof is alpha-terpineol, 0 to 6% of adjuvants and 75 to 90% of water.

More preferably, such cleaner will comprise or consist essentially of about 0.1 to about 0.7% of xanthan gum, about 4% of sodium paraffin ($C_{14-17}$) sulfonate, about 3% of the nonionic detergent, about 5% of 2:5:1 mix of the dicarboxylic acids, about 0.2% of phosphoric acid, about 0.05% of aminotris-(methylenephosphonic acid), about 1% of perfume, which includes about 0.8% of alpha-terpineol, about 0.7% of magnesium sulfate (anhydrous), about 3% of adjuvants and balance being water.

The other preferred formula comprises 0.5 to 2% of sodium paraffin sulfonate, wherein the paraffin is $C_{14-17}$, 2 to 4% of sodium ethoxylated higher fatty alcohol sulfate, wherein the higher fatty alcohol is of 10 to 14 carbon atoms and which contains 1 to 3 ethylene oxide groups per mole, 2 to 4% of nonionic detergent which is a condensation product of fatty alcohol of 9 to 15 carbon atoms with 3 to 15 moles of ethylene oxide per mole of fatty alcohol, 3 to 7% of a 1:1:1 mixture of succinic, glutaric and adipic acids, 0.1 to 0.3% of phosphoric acid, 0.01 to 0.05% of aminotris-(methylenephosphonic acid), 0.09 to 0.17% of magnesium ion, 0.5 to 2% perfume, of which at least 10% is terpene(s) and/or terpineol, 0.1 to 0.7% of the xanthan gum, 0 to 5% of adjuvant(s) and 75 to 90% of water. More preferably, such cleaner, with two anionic detergents, will comprise about 1% of sodium paraffin ($C_{14-17}$) sulfonate, about 3% of sodium ethoxylated higher fatty alcohol sulfate wherein the higher fatty alcohol is lauryl alcohol and the degree of ethoxylation is 2 moles of ethylene oxide per mole, about 3% of nonionic detergent which is a condensation product of a $C_{9-11}$ linear alcohol and 5 moles of ethylene oxide, about 5% of a 1:1:1 mixture of succinic, glutaric and adipic acids, about 0.2% of phosphoric acid, about 0.03% of aminotris-(methylenephosphonic acid), about 0.7% of magnesium sulfate (anhydrous), 0.1 to 0.7% of the xanthan gum, about 2% of adjuvants and the balance being water.

The pH of the various preferred microemulsion cleaners is usually 1 to 4, preferably 1.5 to 3.5, preferably 3. The water content of the thickened microemulsions will usually be in the range of 75 to 90%, preferably 80 to 85% and the adjuvant content will be from 0 to 5%, usually 1 to 3%. If the pH is not in the desired range it will usually be adjusted with either sodium hydroxide or suitable acid, e.g. sulfuric acid, but normally the pH will be raised, not lowered, and it if is to be lowered more of the dicarboxylic acid mixture can be used, instead.

The liquid cleaners can be manufactured by mere mixing of the various components thereof, with orders or additions not being critical. However, it is desirable for the xanthan gun to be first mixed with the water, various water soluble components to be mixed together into the xanthan gum solution, the oil soluble components to be mixed together in a separate operation, and the two mixes to be admixed, with the oil soluble portion being added to the water soluble portion (in the water) with stirring or other agitation.

In some instances, such procedure may be varied to prevent any undesirable reactions between components. For example, one would not add concentrated phosphoric acid directly to magnesium sulfate or to a dye, but such additions would be of aqueous solutions, preferably dilute of the components.

The cleaner may desirably be packed in manually operated spray dispensing containers, which are usually and preferably made of synthetic organic polymeric plastic material, such as polyethylene, polypropylene or polyvinyl chloride (PVC). Such containers also preferably include nylon or other non-reactive plastic closure, spray nozzle, dip tube and associated dispenser parts, and the resulting packaged cleaner is ideally suited for use in "spray and wipe" applications. However, in some instances, as when lime scale and soap scum deposits are heavy, the cleaner may be left on until it has dissolved or loosened the deposit(s) and may then be wiped off, or may be rinsed off, or multiple applications may be made, followed by multiple removals, until the deposits are gone.

The following examples in wt. % illustrates but do not limit the invention. All parts, proportions and percentages in the examples, the specification and claims are by weight and all temperatures are in °C unless otherwise indicated.

| | A | B | C | D | E | F |
|---|---|---|---|---|---|---|
| Na $C_{14-17}$ paraffin sulfonate | 4.0 | 4.0 | 4.0 | 4.0 | 4.0 | 4.0 |
| Nonionic surfactant ($C_{13-17}$ fatty alcohol EO 7:11 PO 4:1) | 4.0 | 4.0 | 4.0 | 4.0 | 4.0 | 4.0 |
| $MgSO_4.7H_2O$ | 1.35 | 1.35 | 1.35 | 1.35 | 1.35 | 1.35 |
| Succinic Acid | 1.67 | 1.67 | 1.67 | 1.67 | 1.67 | 1.67 |
| Glutamic Acid | 1.67 | 1.67 | 1.67 | 1.67 | 1.67 | 1.67 |
| Adipic Acid | 1.67 | 1.67 | 1.67 | 1.67 | 1.67 | 1.67 |
| Amino trismethylene phosphonic acid | 0.025 | 0.025 | 0.025 | 0.025 | 0.025 | 0.025 |
| Dye | 0.1 | 0.1 | 0.1 | 0.1 | 0.1 | 0.1 |
| NaOH (50%) | 0.06 | 0.06 | 0.06 | 0.06 | 0.06 | 0.06 |
| Na Benzoate | 0.3 | 0.3 | 0.3 | 0.3 | 0.3 | 0.3 |
| K Benzoate | 0.3 | 0.3 | 0.3 | 0.3 | 0.3 | 0.3 |
| Xanthan gum | 0.3 | | | | | |
| Methyl hydroxy-propyl cellulose | | 0.3 | | | | |
| Polyox (M.W 300,000) | | | | 0.4 | | |
| Pluracol | | | | | 1.0 | |
| Dapral T210 | | | | | | 0.3 |
| Hydroxy ethyl cellulose | | | | | | |
| Acrysol ICS-1 (polyacrylate) | | | | | | |
| Carbopol 940 | | | 0.4 | | | |
| Polyvinyl alcohol | | | | | | |
| Narlex Starch (National Starch) | | | | | | |
| Polysaccharide (Henkel) | | | | | | |
| Antil Polyacrylamide (Goldschmidt) | | | | | | |
| Water | Bal. | Bal. | Bal. | Bal. | Bal. | Bal. |
| Stability | Stable >30 days | Unstable <1 hour | Unstable <1 hour | Unstable < 14 days | Stable | Stable |
| Thickening | Yes shearing thinning | none | none | immediate decrease in viscosity | none | none |

| | G | H | I | J | K | L |
|---|---|---|---|---|---|---|
| Na $C_{14-17}$ paraffin sulfonate | 4.0 | 4.0 | 4.0 | 4.0 | 4.0 | 4.0 |
| Nonionic surfactant ($C_{13-17}$ fatty alcohol EO 7:11 PO 4:1) | 4.0 | 4.0 | 4.0 | 4.0 | 4.0 | 4.0 |
| $MgSO.7H_2O$ | 1.35 | 1.35 | 1.35 | 1.35 | 1.35 | 1.35 |
| Succinic Acid | 1.67 | 1.67 | 1.67 | 1.67 | 1.67 | 1.67 |
| Glutaric Acid | 1.67 | 1.67 | 1.67 | 1.67 | 1.67 | 1.67 |
| Adipic Acid | 1.67 | 1.67 | 1.67 | 1.67 | 1.67 | 1.67 |
| Amino trismethylene phosphonic acid | 0.025 | 0.025 | 0.025 | 0.025 | 0.025 | 0.025 |
| Dye | 0.1 | 0.1 | 0.1 | 0.1 | 0.1 | 0.1 |
| NaOH (50%) | 0.06 | 0.06 | 0.06 | 0.06 | 0.06 | 0.06 |
| Na Benzoate | 0.3 | 0.3 | 0.3 | 0.3 | 0.3 | 0.3 |
| K Benzoate | 0.3 | 0.3 | 0.3 | 0.3 | 0.3 | 0.3 |
| Xanthan gum | | | | | | |
| Methyl hydroxy-propyl cellulose | | | | | | |

-continued

| | | | | | | |
|---|---|---|---|---|---|---|
| Polyox (M.W 300,000) | | | | | | |
| Pluracol | | | | | | |
| Dapral T210 | | | | | | |
| Hydroxy ethyl cellulose | 0.5 | | | | | |
| Acrysol ICS-1 (polyacrylate) | | 0.5 | | | | |
| Carbopol 940 | | | | | | |
| Polyvinyl alcohol | | | 0.5 | | | |
| Narlex Starch (National Starch) | | | | 0.5 | | |
| Polysaccharide (Henkel) | | | | | 0.5 | |
| Antil Polyacrylamide (Goldschmidt) | | | | | | 0.5 |
| Water | Bal. | Bal. | Bal. | Bal. | Bal. | Bal. |
| Stability | Unstable <1 hour | Stable | Unstable <24 hours | Unstable <24 hours | Unstable <24 hours | Unstable <24 hours |
| Thickening | none | none | | | | |

The compositions (A–L) were made by dissolving the thickeners and benzoates and then dissolving the detergents in the water, after which the rest of the water soluble materials are added to the detergent solution, with stirring, except for the perfume and any adjusting agent (sodium hydroxide solution). The pH is adjusted to 3.0 and then the perfume is stirred into the aqueous solution, instantaneously generating the desired microemulsion, which is clear blue. The acid cleaner is packed in polyethylene squeeze bottle equipped with polypropylene spray nozzles which are adjustable to closed spray and stream positions. In use the microemulsion is sprayed onto "bathtub ring" on a bathtub, which also includes lime scale, in addition to soap scum and greasy soil. The rate of application is about 5 ml. per 5 meters of ring (which is about 3 cm. wide). After application and a wait of about two minutes the ring is wiped off with a sponge and is sponged off with water, it is found that the greasy soil, soap scum, and even the lime scale, have been removed effectively. In those cases where the lime scale is particularly thick or adherent a second application may be desirable, but that is to considered to be the norm.

The tub surface may be rinsed because it is so easy to rinse a bathtub (or a shower) but such rinsing is not necessary.

Sometimes dry wiping will be sufficient but if it is desired to remove any acidic residue the surface may be sponged with water or wiped with a wet cloth but in such case it is not necessary to use more than ten times the weight of cleaner applied. In other words, the surface does not need to be thoroughly doused or rinsed with water, and it still will be clean and shiny (providing that it was originally shiny). In other uses of the cleaner, it may be employed to clean shower tiles, bathroom floor tiles, kitchen tiles, sinks and enamelware, generally, without harming the surfaces thereof. It is recognized that many of such surfaces are acid-resistant but a commercial product must be capable of being used without harm on even less resistant surfaces, such as European enamel (often on a cast iron or sheet steel base) which is sometimes referred to as zirconium white powder enamel. It is a feature of the cleaner described above (and other cleaners of this invention) that they clean hard surfaces effectively but they do contain ionizable acids and therefore should not be applied to acidsensitive surfaces. Nevertheless, it has been found that they do not harm European white enamel bathtubs, in this example, which are seriously affected by cleaning with preparations exactly like that of this example except for the omission from them of the phosphonic acid or the phosphoric-phosphoric acid mixture.

The major component of the formulation that protects the European enamels is the phosphonic acid and in the formula the amount of such acid has been reduced below the minimum normally required at a pH of 3. Yet, although 0.5% is the minimum normally, when the phosphoric acid is present which is ineffective in itself at such pH. It increases the effect of the phosphonic acid, allowing a reduction in the proportion of the more expensive phosphonic acid.

What is claimed:

1. A thickened, shear thinning acidic microemulsion composition which comprises approximately by weight:

(a) 1 to 6 percent of an anionic surfactant;

(b) 1 to 6 percent of a nonionic surfactant;

(c) 0 to 0.7 percent of a preservative;

(d) 0.1 to 0.7 percent of a xanthan gum thickener having a molecular weight of about 1,000,000 to 10,000,000;

(e) 0 to 0.3 percent of an alkali metal hydroxide;

(f) 0.05 to 1.0 percent of phosphoric acid;

(g) 0.01 to 0.5 percent of an amino alkylene phosphonic acid;

(h) 2 to 10 percent of an acid mixture of succinic acid, glutaric acid and adipic acid in a ratio of about 1:1:1; and (i) the balance being water, wherein the composition has a pH of about 1 to about 4 and a Brookfield viscosity of about 200 to 1,000 cps at R.T. using a #2 spindle at 50 rpms.

2. A composition according to claim 1, in which the ratio of component (h) to component (g) is in the range of 5:1 to 250:1.

3. A composition according to claim 1 wherein the anionic surfactant is a water soluble salt of a lipophilic organic sulfonic acid a water soluble salt of a lipophilic organic sulfuric acid or mixtures thereof; and wherein the nonionic surfactant is a condensation product of a lipophilic alcohol or phenol with lower alkylene oxide, and wherein the aminoalkylenephosphonic acid is selected from the group consisting of aminotris(methylene-phosphonic acid), ethylenediamine tetra-(methylenephosphonic acid), hemamethylene diamine tetra-(methylenephosphonic acid) and diethylenetriamine penta-(methylenephosphonic acid) and mixtures thereof.

4. A composition according to claim 1 wherein the anionic surfactant is selected from the group consisting of water soluble higher paraffin sulfonate and water soluble ethoxylated higher fatty alcohol sulfate having 1 to 10 ethylene oxide groups per mole, and mixtures thereof, the nonionic surfactant is a condensation product of a fatty alcohol of 9 to 15 carbon atoms with from 3 to 15 moles of lower alkylene oxide per mole of higher fatty alcohol.

5. A process for removing any one or more of lime scale, soap scum, and greasy soil or mixtures thereof from bathtubs or other hard surfaced items, which are acid resistant or are of zirconium white enamel, which comprises applying to such a surface a composition in accordance with claim 1 and removing such composition and the lime scale, soap scum and/or greasy soil from such surface.

* * * * *